US006011350A

United States Patent [19]

Opresko et al.

[11] Patent Number: 6,011,350

[45] **Date of Patent: *Jan. 4, 2000**

[54] COLOR PICTURE TUBE FACEPLATE PANEL

[75] Inventors: Stephen Thomas Opresko, Lancaster; Richard Wayne Hutzler, Willow Street, both of Pa.

[73] Assignee: Thomson Consumer Electronics, Inc., Indianapolis, Ind.

[ * ] Notice: This patent issued on a continued prosecution application filed under 37 CFR 1.53(d), and is subject to the twenty year patent term provisions of 35 U.S.C. 154(a)(2).

[21] Appl. No.: 08/635,183

[22] Filed: Apr. 25, 1996

[51] Int. Cl.[7] ..... H01J 31/00

[52] U.S. Cl. ..... 313/477 R; 220/2.1 A; 220/2.3 A

[58] Field of Search ..... 313/477 R; 220/2.3 A, 220/2.1 A

[56] References Cited

U.S. PATENT DOCUMENTS

| | | | |
|---|---|---|---|
| 3,002,645 | 10/1961 | Kegg | 220/2.1 |
| 3,264,080 | 8/1966 | Mayhew et al. | 65/72 |
| 3,314,566 | 4/1967 | Minnemann et al. | 220/2.1 A |
| 3,381,347 | 5/1968 | Reinwall, Jr. | 29/25.13 |
| 3,390,033 | 6/1968 | Brown | 156/24 |
| 3,403,805 | 10/1968 | Powell et al. | 220/2.1 A |
| 3,419,375 | 12/1968 | Meiresonne | 65/181 |
| 3,623,196 | 11/1971 | Bongenaar et al. | 220/2.1 A |
| 5,568,011 | 10/1996 | Raglang, Jr. et al. | 313/477 R |

FOREIGN PATENT DOCUMENTS

| | | | |
|---|---|---|---|
| 59-086137 | 5/1984 | Japan | H01J 29/86 |
| 3 272551 | 12/1991 | Japan | H01J 29/86 |
| 7 320661 | 12/1995 | Japan | H01J 29/86 |

OTHER PUBLICATIONS

French Search Report dated: May 14, 1998.

*Primary Examiner*—Harshad Patel

*Attorney, Agent, or Firm*—Joseph S. Tripoli; Dennis H. Irlbeck

[57] ABSTRACT

An improved color picture tube includes a glass envelope comprising a faceplate panel, a funnel and a neck. The faceplate panel has four sides and four corners and includes a transparent rectangular faceplate, having a cathodoluminescent screen on an interior surface thereof, and a sidewall peripherally extending from the faceplate. The end of the sidewall facing the funnel has a seal land that is sealed to the funnel. The improvement comprises the sidewall seal land having a varied width around the periphery of the panel, wherein the widest portions of the sidewall seal land are located along the panel sides and the narrowest portions of the sidewall seal land are located at the corners of the panel. The width of the sidewall seal land is from 5% to 17% less in the corners of the panel than at the centers of the sides of the panel.

1 Claim, 3 Drawing Sheets

COLOR PICTURE TUBE FACEPLATE PANEL

This invention relates to color picture tubes and, particularly, to variations in the designs of faceplate panels to accommodate stretched panels and to reduce the weight of the panels, while retaining sufficient panel strength to withstand atmospheric pressures.

BACKGROUND OF THE INVENTION

A color picture tube has a glass envelope that comprises a neck, a funnel and a rectangular faceplate panel. The faceplate panel includes a viewing faceplate that is surrounded by a peripheral sidewall. The sidewall of the faceplate panel is sealed to a large end of the funnel by a glass frit. The surfaces of the facing ends of the panel sidewall and the funnel are called their seal lands. Between the panel sidewall and the panel faceplate, there is a transition zone that includes a blend radius. Recently, there has been an effort to expand or stretch the size of a tube screen by reducing the blend radius at least in the corners of a tube, while not enlarging the overall exterior size and dimensions of the tube.

One of the problems that occurs when the blend radius of a panel is changed is that the inner surface of the panel sidewall become less sloped relative to the sidewall seal land, i.e., Ø in FIG. 3 gets smaller. This shallower slope creates a problem in removing the panel forming plunger from the panel during panel forming in a glass factory. This problem cannot be solved by making the entire panel sidewall thinner, because panel sidewall thickness affects the strength of the panel, and panel strength must be maintained for the tube to withstand the atmospheric load on it and to meet safety criteria. Therefore, there is a need for a new panel design that will retain strength, and maintain a large slope Ø necessary for ease of removal from a mold during fabrication.

SUMMARY OF THE INVENTION

The present invention provides an improvement in a color picture tube of a type that includes a glass envelope comprising a faceplate panel, a funnel and a neck. The faceplate panel has four sides and four corners and includes a transparent rectangular faceplate, having a cathodoluminescent screen on an interior surface thereof, and a sidewall peripherally extending from the faceplate. The end of the sidewall facing the funnel has a seal land that is sealed to the funnel. The improvement comprises the sidewall seal land having a varied width around the periphery of the panel, wherein the widest portions of the sidewall seal land are located along the panel sides and the narrowest portions of the sidewall seal land are located at the corners of the panel. The width of the sidewall seal land is from 5% to 17% less in the corners of the panel than at the centers of the sides of the panel.

DETAILED DESCRIPTION OF THE PREFERRED EMBODIMENTS

Figure 1:
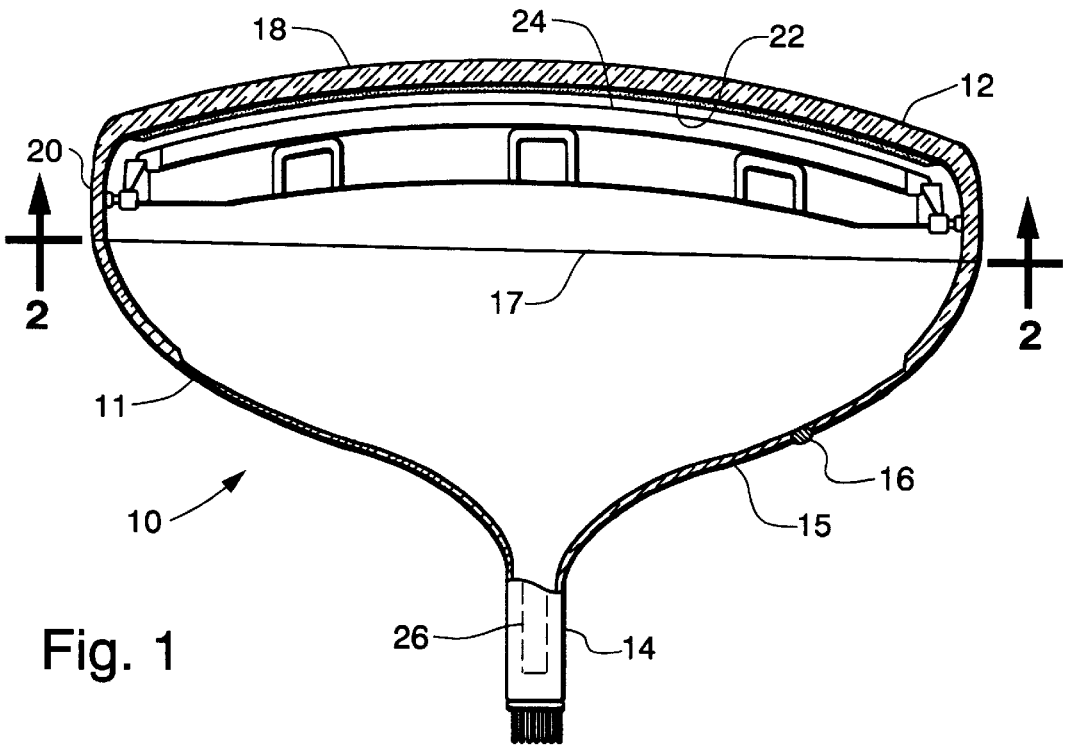
FIG. 1 is a side view, partly in axial section, of a color picture tube.
Figure 2:
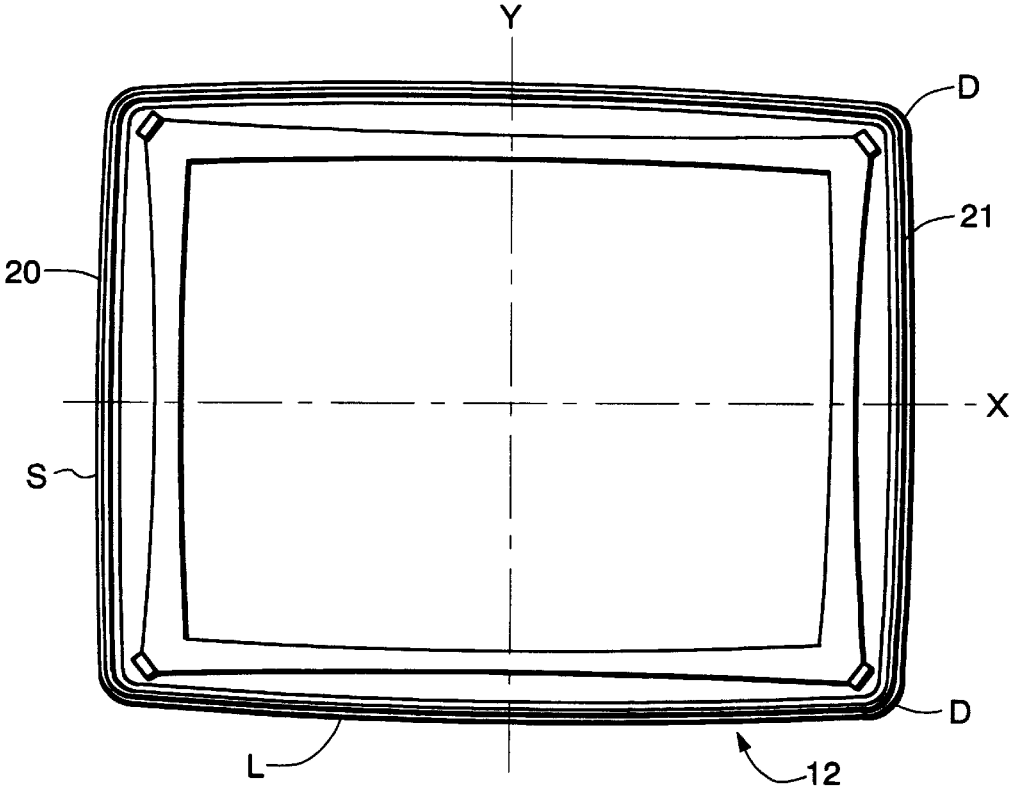
FIG. 2 is a plan view of the rear of the faceplate panel taken at lines 2—2 of FIG. 1.

FIGS. 1 and 2 show a rectangular color picture tube 10 having a glass bulb or envelope 11 comprising a rectangular faceplate panel 12 and a tubular neck 14 connected by a rectangular funnel 15. The funnel 15 has an internal conductive coating (not shown) that extends from an anode button 16 to the neck 14. The panel 12 comprises a transparent rectangular viewing faceplate 18, and a peripheral flange or sidewall 20 which includes a seal land 21 that is sealed to the funnel 15 by a glass frit 17. A three-color phosphor screen 22 is carried by the inner surface of the faceplate 18. The screen 22 is, preferably, a line screen with the phosphor lines arranged in triads, each triad including a phosphor line of each of the three colors. Alternatively, the screen can be a dot screen, and it may or may not include a light-absorbing matrix. A multi apertured color selection electrode or shadow mask 24 is removably mounted in predetermined spaced relation to the screen 22. An electron gun 26, shown schematically by dashed lines in FIG. 1, is centrally mounted within the neck 14 to generate and direct three electron beams along convergent paths through the mask 24 to the screen 22.

As shown in FIG. 2, the rectangular faceplate panel 12 includes two centrally located orthogonal axes, a major axis X and a minor axis Y, and two diagonals D that extend corner-to-corner. The two long sides L of the periphery of the faceplate panel 12 substantially parallel the major axis X, and the two short sides S substantially parallel the minor axis Y.

Figure 3:
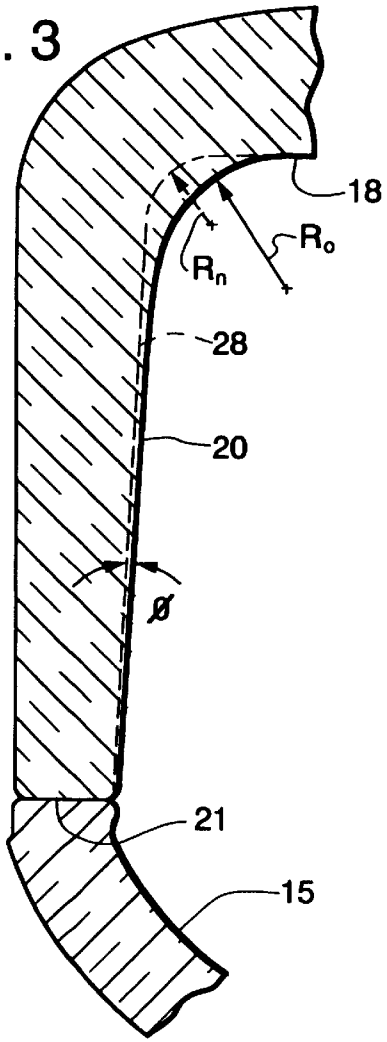

FIG. 3 shows a cross-section of the panel 12 at the end of a diagonal D. The dashed line 28 indicates a revised shape of the inner surface of the panel, where the screen area is stretched by reducing the radius of curvature or blend radius between the faceplate 18 and the sidewall 20, while maintaining the width of the sidewall or panel seal land 21. The requirements for a larger screen include a change in contour of the inner surface and a change in the slope of the inner surface of the sidewall by an angle Ø. In a tube, where the blend radius, designated $R_o$ and $R_n$, respectively, is changed from 12.7 mm (0.50 inch) to 2.54 mm (0.10 inch), the angle Ø is about one degree, 1°. The slope angle change creates a problem during panel manufacturing, because the steeper slope causes difficulties in removing a shaping plunger (not shown) from the panel during panel manufacturing.

Figure 5:
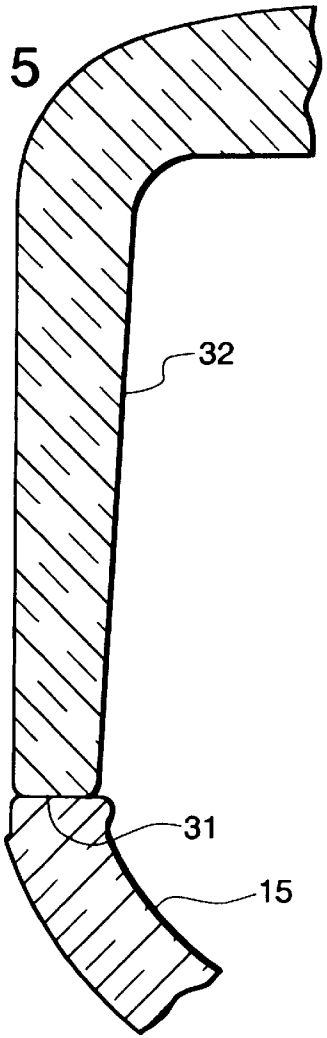
FIGS. 3, 4 and 5 are cross-sectional views of the sidewalls of faceplate panels and portions of funnels, illustrating the prior art, development problems and the present invention.
Figure 4:
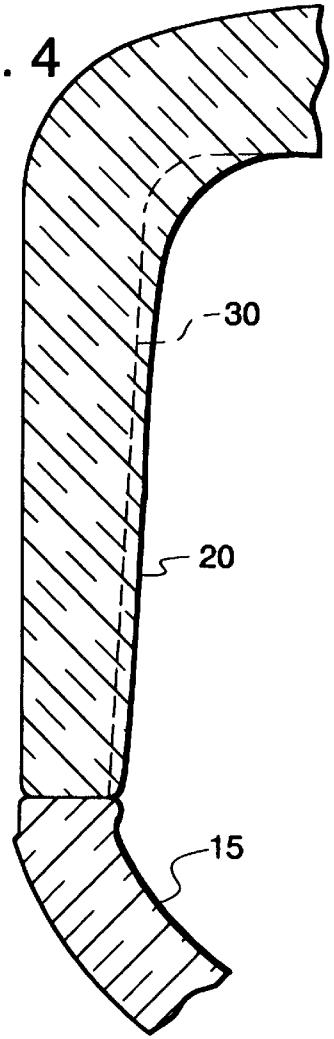
Fig. 4 PRIOR ART
Figure 6:
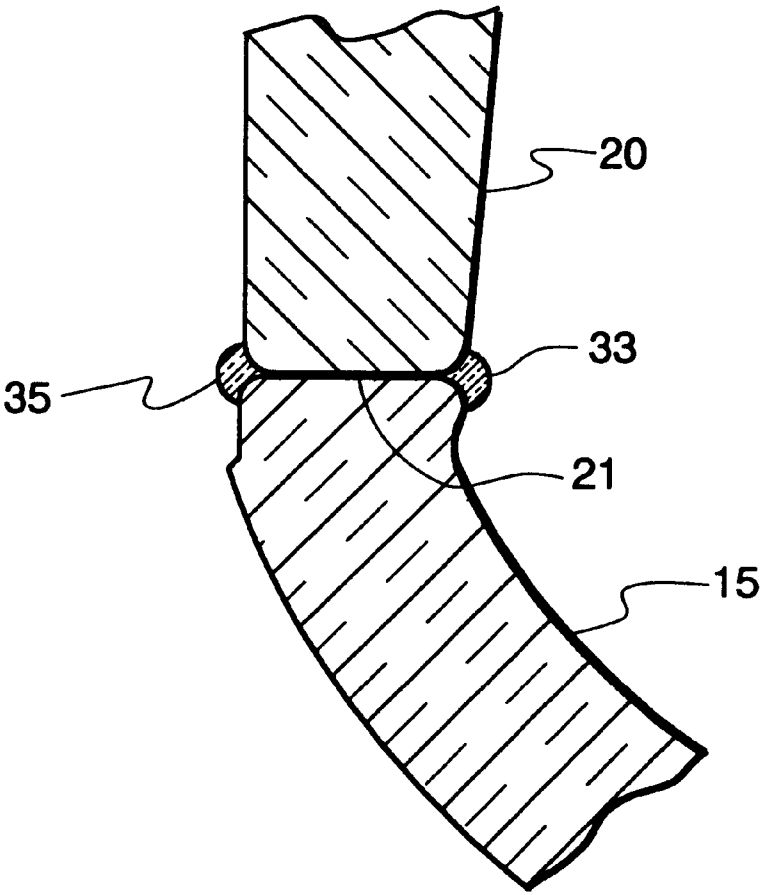

An embodiment that solves the glass manufacturing problem is shown by the dashed line 30 in FIG. 4 and by the solid line 32 in FIG. 5. In this solution, the blend radius is changed the same amount that it was in FIG. 3, but the sidewall or panel seal land 31 is narrower, to maintain the same slope angle of the inner surface of the sidewall. However, another problem, related to strength, is caused by a narrower panel seal land around the entire perimeter of the panel. This latter problem is illustrated by comparing FIG. 6 with FIG. 7. FIG. 6 shows a panel embodiment where the seal land 21 of the panel is substantially the same width as the seal land of the funnel. In this case, the frit material forms rather full fillets 33 and 35 on both the inside and outside of the tube. However, in the panel embodiment shown in FIG. 7, where the width of the seal land 31 of the panel is substantially less than the width of the seal land of the funnel, the frit material forms a full fillet 37 on the outside of the tube, but a distorted partial fillet 39 on the inside of the tube. When this condition occurs along the side of a panel, it results in a greatly weakened joint between the panel and funnel.

Figure 7:
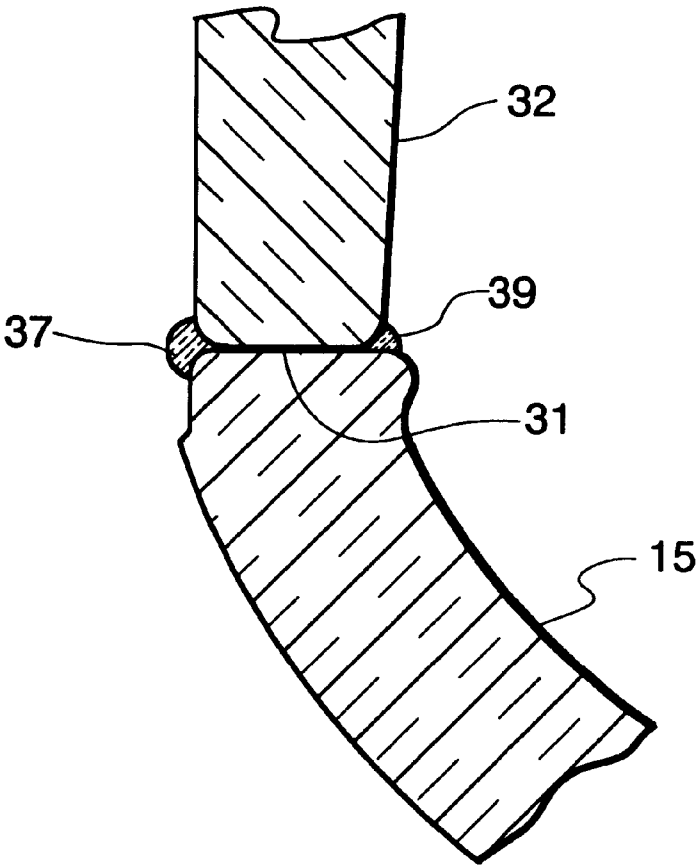
FIGS. 6 and 7 are cross-sectional views of the junctions between faceplate panel sidewalls and funnels.

Typically in prior art tubes, the width of the seal land on the panel is relatively uniform around the perimeter of the panel, varying less than 5%. However, it has been found that, when the glass envelope is evacuated, the mechanical stresses in the faceplate panel, caused by vacuum loading, are highest at the ends of the major and minor axes, at the center of the four sides, and lowest at the corners of the panel, at the ends of the diagonals. Furthermore, it has been found that an appropriate amount of mechanical strength can be maintained within a tube that has a reduction in the seal land width, in the corners of the panel only, of from 5% to 17%. In the novel tube of the present invention, therefore, the panel seal land is widest along the sides L and S of the panel, as shown in FIG. 6, and narrowest at the corners of the panel, as shown in FIG. 7.

What is claimed is:

1. In a color picture tube including a glass envelope comprising a faceplate panel, a funnel and a neck, said faceplate panel having four sides and four corners and including a transparent rectangular faceplate and a peripheral sidewall, said sidewall having a seal land that is sealed to said funnel, the improvement comprising said sidewall seal land having a varied width around said panel, wherein the widest portions of said sidewall seal land are located along said panel sides and the narrowest portions of said sidewall seal land are located at the corners of said panel, and wherein the width of said panel sidewall seal land is from 5% to 17% less in the corners of said panel than at the sides of said panel.

* * * * *